US006745482B1

(12) United States Patent
Mallozzi

(10) Patent No.: US 6,745,482 B1
(45) Date of Patent: Jun. 8, 2004

(54) BOW SIGHT WITH REPLACEABLE SIGHT PIN GUARD

(76) Inventor: Anthony Mallozzi, 2482 86th St., Brooklyn, NY (US) 11214

( * ) Notice: Subject to any disclaimer, the term of this patent is extended or adjusted under 35 U.S.C. 154(b) by 0 days.

(21) Appl. No.: 10/383,714

(22) Filed: Mar. 8, 2003

(51) Int. Cl.[7] ..... F41G 1/467
(52) U.S. Cl. ..... 33/265
(58) Field of Search ..... 33/265; 124/87

(56) References Cited

U.S. PATENT DOCUMENTS

| | | | | | |
|---|---|---|---|---|---|
| 4,535,747 | A | | 8/1985 | Kudlacek | 124/87 |
| 4,788,961 | A | | 12/1988 | Toth | 124/87 |
| 4,819,611 | A | | 4/1989 | Sappington | 33/265 |
| 4,999,919 | A | * | 3/1991 | Sparkman | 33/265 |
| 5,094,002 | A | * | 3/1992 | Saunders | 33/265 |
| 5,383,279 | A | * | 1/1995 | Tami | 33/265 |
| 5,413,084 | A | | 5/1995 | Haggard | 33/265 |
| 5,419,051 | A | * | 5/1995 | Barngrover | 33/265 |
| 5,419,303 | A | * | 5/1995 | Stewart | 124/87 |
| 5,488,941 | A | | 2/1996 | Springstead | 124/86 |
| 5,600,746 | A | * | 2/1997 | Arnett | 385/53 |
| 5,676,122 | A | | 10/1997 | Wiseby et al. | 33/265 |
| 5,685,081 | A | * | 11/1997 | Winegar | 33/265 |
| 5,737,887 | A | * | 4/1998 | Smeenge | 52/282.2 |
| 6,061,919 | A | | 5/2000 | Reichert | 124/87 |
| 6,260,964 | B1 | * | 7/2001 | Kroman | 351/47 |
| 6,463,665 | B1 | * | 10/2002 | Gomez-Vazquez | 33/265 |
| 2002/0042999 | A1 | * | 4/2002 | Lorocco | 33/265 |
| 2002/0083602 | A1 | * | 7/2002 | Slates | 33/265 |
| 2003/0136012 | A1 | * | 7/2003 | Walbrink | 33/265 |

OTHER PUBLICATIONS

Six (6) Pages from Assorted Archery Magazines and Catalogs Depicting Various Bow Pin Sights, no date.

* cited by examiner

*Primary Examiner*—G. Bradley Bennett
(74) *Attorney, Agent, or Firm*—Bernard S. Hoffman

(57) ABSTRACT

An improved bow sight of the type having a base for mounting to a bow, at least one sight pin extending from the base, and a sight pin guard attached to the base and overlying the at least one sight pin. The improvement includes the sight pin guard being replaceably attached to the base in such a manner so as to allow the sight pin guard to be removed from the base without a need for tools and not obstruct view of a target during aiming and be replaced onto the base without a need for tools when protecting the at least one sight pin from damage is desired. The improvement further includes two embodiments of apparatus for replaceably attaching the sight pin guard to the base without a need for tools. The first embodiment includes terminal ends of the sight pin guard and ends of the base having cooperating slots. The second embodiment includes the terminal ends of the sight pin guard formed with indents that cooperate with spring clips on the ends of the base.

18 Claims, 3 Drawing Sheets

BOW SIGHT WITH REPLACEABLE SIGHT PIN GUARD

CROSS REFERENCE TO RELATED APPLICATIONS

The instant application contains subject matter disclosed in applicant's Disclosure Document Number 515604, filed Jul. 29, 2002, and entitled REMOVABLE SIGHT PIN GUARD.

BACKGROUND OF THE INVENTION

1. Field of the Invention

The present invention relates to a bow sight. More particularly, the present invention relates to a bow sight with replaceable sight pin guard.

2. Description of the Prior Art

Archery requires precise aiming. To this end, even small improvements in the ability to sight are valuable benefits. The sighting devices utilized in archery have not changed greatly over the years. In most modern sighting systems, a sight extends from the bow handle and includes sight pins.

Because these sight pins on a hunter's bow are very susceptible to breakage during movement through underbrush and foliage common in hunting grounds, hunter bow sights of the pin type include fixed protective frames overlying the sight pins. These fixed protective frames, however, obstruct view of the target and thereby hinder aiming.

Thus, there exists a need for a bow sight having a pin guard that protects the sight pins when desired, but does not obstruct view of the target during aiming.

Numerous innovations for bow sights have been provided in the prior art that will be described infra. Even though these innovations may be suitable for the specific individual purposes to which they address, they each differ in structure and/or operation and/or purpose from the present invention in that they do not teach a bow sight having a pin guard that protects the sight pins when desired, but does not obstruct view of the target during aiming.

FOR EXAMPLE, typical prior art pin type bow sights include, to name a few, the "Cyclone," the Lightning," the "Thunder," and the "Toxonics™ Hybrid 4," all manufactured by Browning Archery.

A typical prior art pin type bow sight 10 can best be seen in FIG. 1, which is a diagrammatic perspective view of a bow with a typical prior art pin type bow sight thereon, and as such, will be discussed with reference thereto.

The typical prior art pin type bow sight 10 has a base 12 for mounting to a bow 14, at least one sight pin 16 extending from the base 12, and a sight pin guard 18 attached to the base 12 and overlying the at least one sight pin 16. The base 12 has a bow-facing surface 20, an ambient-facing surface 22 that is opposite to the bow-facing surface 20, and a pair of ends 24. The sight pin guard 18 has a pair of legs 26 with terminal ends 27, inner-facing surfaces 28, and outer-facing surfaces 30.

ANOTHER EXAMPLE, U.S. Pat. No. 4,535,747 to Kudlacek teaches an archery bow sight that includes a base plate arranged for removable attachment to the handle portion of a bow and supporting a longitudinally extendable mounting arm which mounts at its forward end a horizontally adjustable bow sight windage carriage which, in turn, mounts an elevation carriage provided for micrometrically graduated vertical movement perpendicular to the plane of movement of the aforesaid windage carriage. An elongated sight pin mounting block mounts a plurality of sighting pins for individual adjustment parallel and perpendicular to the longitudinal dimension of the block in order to provide yardage and elevation adjustment of each pin for sighting on targets of various distances while also providing for horizontal adjustment of each pin for various windage conditions.

STILL ANOTHER EXAMPLE, U.S. Pat. No. 4,788,961 to Toth teaches an archery bow having accessories attached to the bow by a support block having an internal opening which receives a tang extending from an archery accessory. Accessories which may be attached to the bow include a detachable sight, an auxiliary arrow holder and a bow-fishing reel. More than one accessory may be locked to the support block. A shoulder is formed where the tang extends from the accessory to aid in positioning the accessory in the support block. The auxiliary arrow holder is an arm having an arrow support bracket on the end opposite the tang which includes a plurality of resilient fingers aligned on opposite sides and axially offset from each other for gripping the shaft of an arrow. The bow-fishing accessory includes a reel having a thin rim with a concave perimeter and a brace offset from the central axis of the rim. The reel is connected to the support block by an arm extending between the brace and the tang. A detachable quiver may be attached to the support block with the support block including one part of the detachable quiver mount and the quiver including a second part of the detachable quiver mount.

YET ANOTHER EXAMPLE, U.S. Pat. No. 4,819,611 to Sappington teaches a flexible sight pin for an archery bow sighting device in which the flexible sight pin is mounted to the body of the sighting device to permit universal flexing movement of the sight pin upon encountering a force of greater magnitude. The flexible sight pin includes a first portion attached to the body of the sighting device, a second portion constituting an elongated flexible element connected at one end thereof to the first portion and also to a third portion on the opposite end of the second portion. The third portion terminates in an archer's sight at the free end of the flexible sight pin.

STILL YET ANOTHER EXAMPLE, U.S. Pat. No. 5,413,084 to Haggard teaches an archery sight and arrow rest combination that incorporates the positioning of the sight generally vertically above the arrow rest. Positioning of the sight generally vertically above the arrow rest eliminates any undesirable effects from archer induced torque on the bow handle. Both the sight and rest are positioned rearwardly of the bow handle. Should the bow handle be twisted due to archer induced torque, both the sight and arrow rest will move to effectively the same position. Thus, when the archer sights along the sight member, the arrow will be pointing in the same direction. In the prior art, the arrow rest was often behind the bow handle with the sight in front of the bow handle. When archer induced torque occurred, the archer would be sighting along one line, while the arrow would actually be aimed along another. The combination has addressed this problem. In addition, the combination provides a one-piece easily removable sight and arrow rest combination that the archer may quickly and easily remove. Since the sight and arrow rest are delicate members, facilitating the removal by the archer will ensure that they are easily protected during transport.

YET STILL ANOTHER EXAMPLE, U.S. Pat. No. 5,488,941 to Springstead teaches a brush guard (10) for preventing brush (75) from becoming wedged between the upper limb (101) of a bow (100) and a quiver (200) mounted on the bow (100); wherein, the brush guard (10) includes an elongated brush guard arm member (50) releasably attached to the quiver cap (204) on one end (51) and disposed proximate to the upper limb (101) on the other end (32).

STILL YET ANOTHER EXAMPLE, U.S. Pat. No. 5,676,122 to Wiseby et al. teaches an arrangement for a sight for a bow having at least two independently adjustable sighting members which are capable of being displaced and guided in the desired adjustment direction, and are supported by a guide intended for that purpose. At least one of the sighting members is capable of removable connection to a common drive member extending along the guides for the purpose of adjusting the sighting members independently of one another.

YET STILL ANOTHER EXAMPLE, U.S. Pat. No. 6,061,919 to Reichert teaches a range finder and sight guide for an archer's bow, particularly for hunting of game, such as deer. The device thereof includes a frame removably mounted to the archer's bow and having a pair of vertically oriented guide rails for slidably receiving a slide member. A pair of pivotal arms are rotatably mounted to the slide member where each arm fixedly mounts a horizontally disposed range pin. By manually adjusting the slide member, the respective range pins may be moved closer or farther apart to accurately define the intended game target. Further included is a horizontally disposed sight pin fixedly secured to the slide member and which remains intermediate to and parallel with the range pins irrespective of the vertical position of the slide member.

It is apparent that numerous innovations for bow sights have been provided in the prior art that are adapted to be used. Furthermore, even though these innovations may be suitable for the specific individual purposes to which they address, they would not be suitable for the purposes of the present invention as heretofore described wherein a bow sight having a pin guard protects the at least one sight pin when desired, but does not obstruct view of the target during aiming.

SUMMARY OF THE INVENTION

ACCORDINGLY, AN OBJECT of the present invention is to provide a bow sight with replaceable sight pin guard that avoids the disadvantages of the prior art.

ANOTHER OBJECT of the present invention is to provide a bow sight with replaceable sight pin guard that protects the at least one sight pin when desired, but does not obstruct view of the target during aiming.

STILL ANOTHER OBJECT of the present invention is to provide a bow sight with replaceable sight pin guard that is simple to use.

BRIEFLY STATED, YET ANOTHER OBJECT of the present invention is to provide an improved bow sight of the type having a base for mounting to a bow, at least one sight pin extending from the base, and a sight pin guard attached to the base and overlying the at least one sight pin. The improvement includes the sight pin guard being replaceably attached to the base in such a manner so as to allow the sight pin guard to be removed from the base without a need for tools and not obstruct view of a target during aiming and be replaced onto the base without a need for tools when protecting the at least one sight pin from damage is desired. The improvement further includes two embodiments of apparatus for replaceably attaching the slight pin guard to the base without a need for tools. The first embodiment includes terminal ends of the sight pin guard and ends of the base having cooperating slots. The second embodiment includes the terminal ends of the sight pin guard formed with indents that cooperate with spring clips on the ends of the base.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawing are briefly described as follows.

LIST OF REFERENCE NUMERALS UTILIZED IN THE DRAWING

Prior Art

Figure 1:
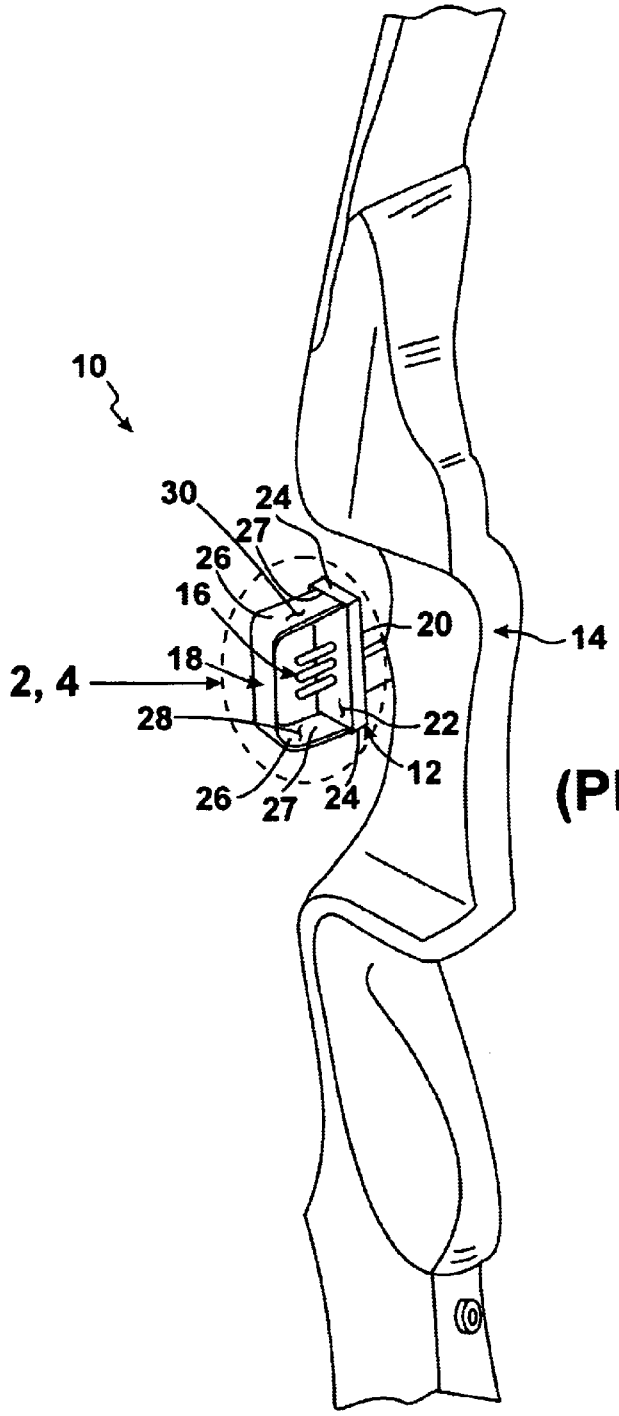
FIG. 1 (PRIOR ART)
FIG. 1 is a diagrammatic perspective view of a bow with a typical prior art pin type bow sight thereon.

10 typical prior art pin type bow sight
12 base of typical prior art pin type bow sight 10 for mounting to bow 14
14 bow
16 at least one sight pin of typical prior art pin type bow sight 10
18 sight pin guard of typical prior art pin type bow sight 10
20 bow-facing surface of base 12 of typical prior art pin type bow sight 10
22 ambient-facing surface of base 12 of typical prior art pin type bow sight 10
24 pair of ends of base 12 of typical prior art pin type bow sight 10
26 pair of legs of sight pin guard 18 of typical prior art pin type bow sight 10
27 terminal ends of pair of legs 26 of sight pin guard 18 of typical prior art pin type bow sight 10
28 inner-facing surfaces of pair of legs 26 of sight pin guard 18 of typical prior art pin type bow sight 10
30 outer-facing surfaces of pair of legs 26 of sight pin guard 18 of typical prior art pin type bow sight 10

Present Invention

110 improved bow sight of present invention
112 base of improved bow sight 110
118 sight pin guard of improved bow sight 110
128 apparatus for replaceably attaching sight pin guard 118 to base 112 of improved bow sight 110

First Embodiment of Apparatus

212 base
218 sight pin guard

220 bow-facing surface of base 212
222 ambient-facing surface of base 212
224 pair of ends of base 212
226 pair of legs of sight pin guard 218
227 terminal ends of pair of legs 226 of sight pin guard 218
228 apparatus
229 inner-facing surfaces of pair of legs 226 of sight pin guard 218
230 pair of blind slots in pair of ends 224 of base 212 of apparatus 228
232 pair of blind slots in inner-facing surfaces 229 of pair of legs 226 of sight pin guard 218 of apparatus 228
234 pair of ramp surfaces on terminal ends 227 of pair of legs 226 of sight pin guard 218 of apparatus 228

Second Embodiment of Apparatus

312 base
318 sight pin guard
320 bow-facing surface of base 312
322 ambient-facing surface of base 312
324 pair of ends of base 312
326 pair of legs of sight pin guard 318
328 apparatus
330 outer-facing surfaces of pair of legs 326 of sight pin guard 318
331 pair of spring clips of base 312 of apparatus 328
332 pair of indents in pair of legs 326 of sight pin guard 318 of apparatus 328
336 body of each spring clip of pair of spring clips 331 of apparatus 328
338 tail of each spring clip of pair of spring clips 331 of apparatus 328
340 head of each spring clip of pair of spring clips 331 of apparatus 328
342 through bore in tail 338 of each spring clip of pair of spring clips 331 of apparatus 328
344 pair of blind bores in bow-facing surface 320 of base 312 of apparatus 328
346 screw of each spring clip of pair of spring clips 331 of apparatus 328

DETAILED DESCRIPTION OF THE INVENTION

Figure 3:
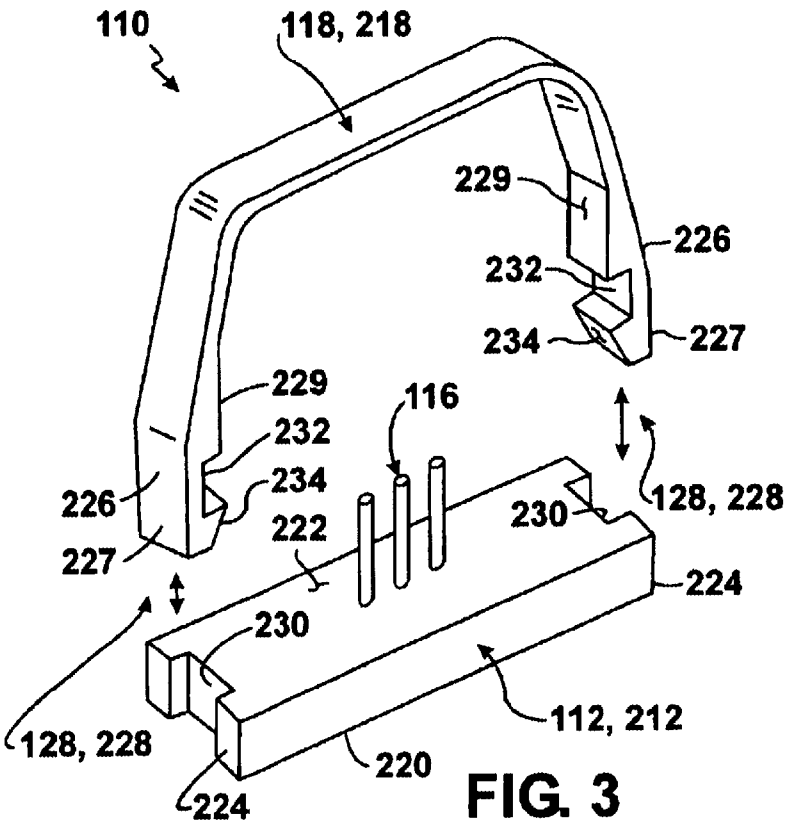
FIG. 3 is an exploded diagrammatic perspective view of the first embodiment of the bow sight incorporating the improvement of the present invention shown in FIG. 2.
Figure 2:
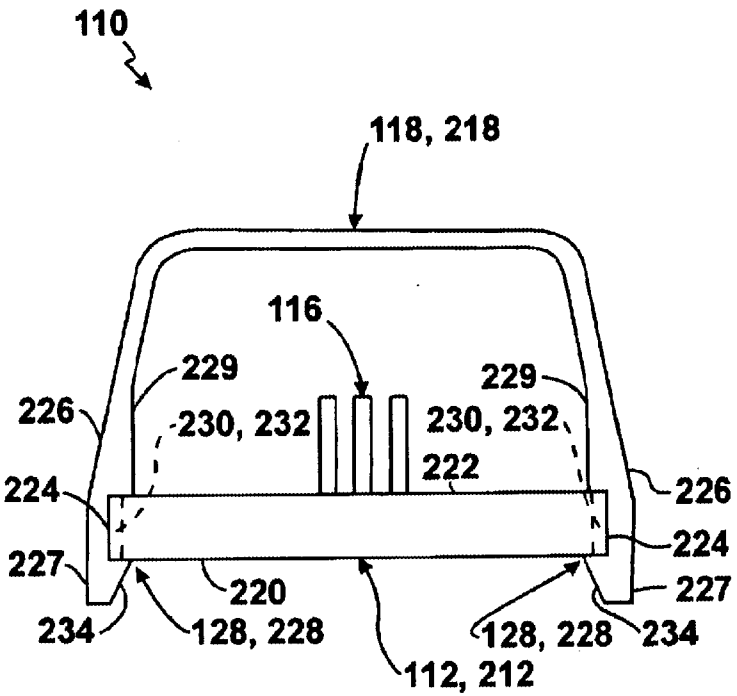
FIG. 2 is an enlarged diagrammatic front elevational view of the area generally enclosed by the dotted curve identified by ARROW 2 in FIG. 1 of a first embodiment of the bow sight incorporating the improvement of the present invention.

Referring now to the figures, in which like numerals indicate like parts, and particularly to FIGS. 2 and 3, which are, respectively, an enlarged diagrammatic perspective view of the area generally enclosed by the dotted curve identified by ARROW 2 in FIG. 1 of a first embodiment of the bow sight incorporating the improvement of the present invention and an exploded diagrammatic perspective view of the first embodiment of the bow sight incorporating the improvement of the present invention shown in FIG. 2, the improved bow sight of the present invention is shown generally at 110 and comprises the sight pin guard 118 being replaceably attached to the base 112 in such a manner so as to allow the sight pin guard 118 to be removed from the base 112 without a need for tools and not obstruct view of a target during aiming and be replaced onto the base 112 without a need for tools when protecting of the at least one sight pin 116 from damage is desired. The improvement further comprises apparatus 128 for replaceably attaching the sight pin guard 18 to the base 112.

The specific configuration of a first embodiment of the apparatus 228 can best be seen in FIGS. 2 and 3, and as such, will be discussed with reference thereto.

The apparatus 228 comprises the base 212 having a pair of blind slots 230 and the pair of legs 226 of the sight pin guard 218 having a pair of blind slots 232 that selectively snapingly engage with the pair of blind slots 230 in the base 212.

The pair of blind slots 230 in the base 212 are disposed in the pair of ends 224 thereof, respectively, and extend vertically therein, from the bow-facing surface 220 thereof to the ambient-facing surface 222 thereof.

The pair of blind slots 232 in the pair of legs 226 of the sight pin guard 218, respectively, extend vertically in the inner-facing surfaces 229 thereof, in proximity to the terminal ends 227 thereof.

The pair of legs 226 of the sight pin guard 218 further have a pair of ramp surfaces 234, respectively. The pair of ramp surfaces 234 on the pair of legs 226 of the sight pin guard 218 extend from the terminal ends 227 of the pair of legs 226 of the sight pin guard 218 to the pair of blind slots 232 in the pair of legs 226 of the sight pin guard 218 and assist in engaging the pair of blind slots 232 in the pair of legs 226 of the sight pin guard 218 with the pair of blind slots 230 in the base 212 by directing the terminal ends 227 of the pair of legs 226 of the sight pin guard 218 down through the pair of blind slots 230 in the base 212.

The pair of blind slots 232 in the pair of legs 226 of the sight pin guard 218 have heights and widths that are a same as that of the pair of blind slots 230 in the base 212 so as to afford snug engagement therebetween.

Figure 5:
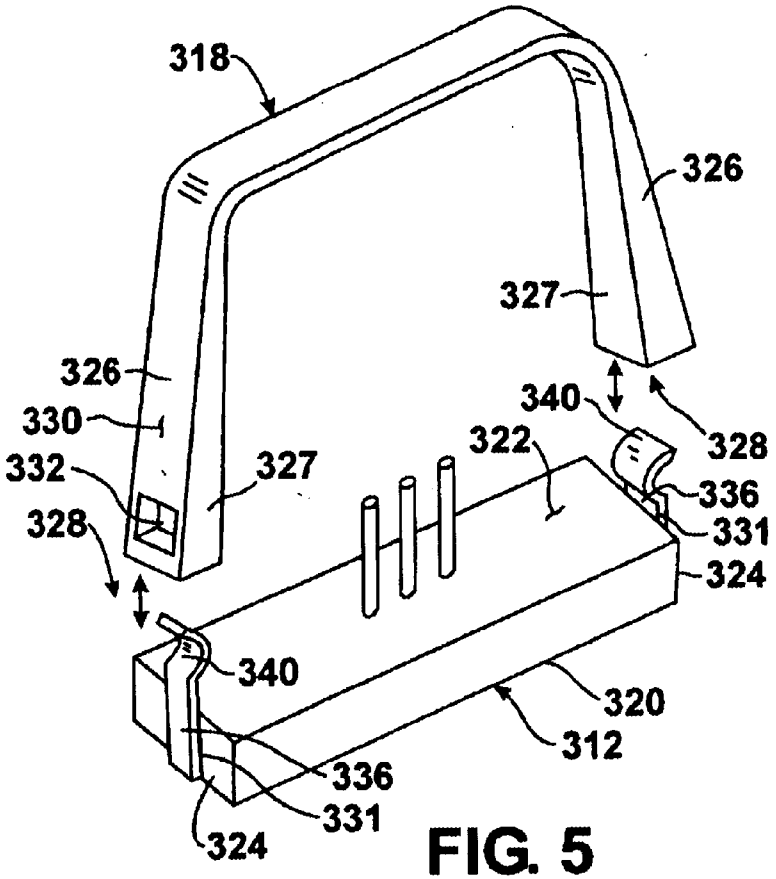
FIG. 5 is an exploded diagrammatic perspective view of the second embodiment of the bow sight incorporating the improvement of the present invention shown in FIG. 4.
Figure 4:
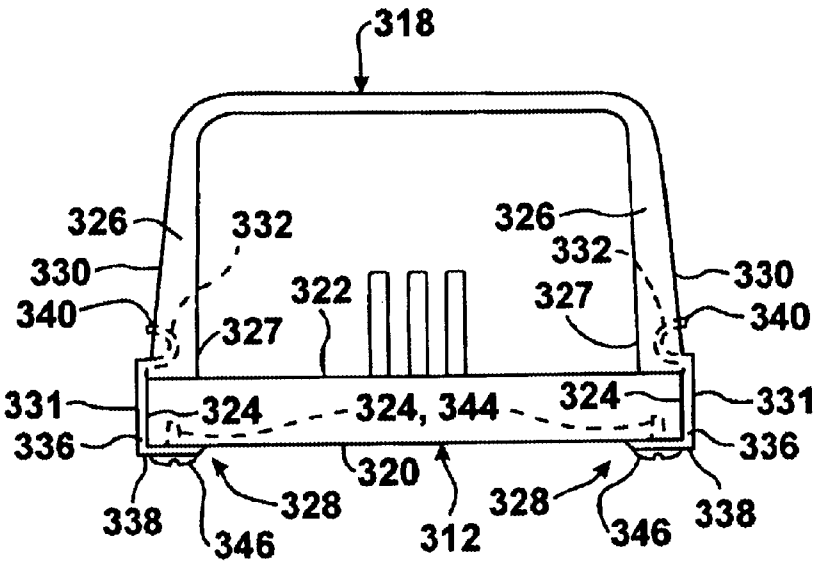
FIG. 4 is an enlarged diagrammatic front elevational view of the area generally enclosed by the dotted curve identified by ARROW 4 in FIG. 1 of a second embodiment of the bow sight incorporating the improvement of the present invention.

The specific configuration of a second embodiment of the apparatus 328 can best be seen in FIGS. 4 and 5, which are, respectively, an enlarged diagrammatic front elevational view of the area generally enclosed by the dotted curve identified by ARROW 4 in FIG. 1 of a second embodiment of the bow sight incorporating the improvement of the present invention and an exploded diagrammatic perspective view of the second embodiment of the bow sight incorporating the improvement of the present invention shown in FIG. 4, and as such, will be discussed with reference thereto.

The apparatus 328 comprises the base 312 having a pair of spring clips 331 and the pair of legs 326 of the sight pin guard 318 having a pair of indents 332 that are selectively snapingly engaged by the pair of spring clips 331 on the base 312.

The pair of spring clips 331 on the base 312 are disposed on the pair of ends 324 thereof, respectively, and extend vertically therealong, from the bow-facing surface 320 thereof to past the ambient-facing surface 322 thereof.

The pair of indents 332 in the pair of legs 326 of the sight pin guard 318, respectively, extend in the outer-facing surfaces 330 thereof, in proximity to the terminal ends 327 thereof.

Each spring clip 331 has a body 336, a tail 338, and a head 340. The body 336 of each spring clip 331 faces an associated end 324 of the base 312, the tail 338 of each spring clip 331 depends from the body 336 thereof and abuts against the bow-facing surface 320 of the base 312, and the head 340 of each spring clip 331 extends upwardly from the body 336 thereof and selectively snaplingly engages in the indent 332 in an associated leg 326 of the sight pin guard 318.

The body of each spring clip 331 is flat, the tail 338 of each spring clip 331 is flat, and the head 340 of each spring clip 331 is C-shaped and sized to afford a snug engagement in the indent 332 in the associated leg 326 of the sight pin guard 318.

The tail 338 of each spring clip 331 has a through bore 342 that aligns with an associated one of a pair of blind bores

344 in the bow-facing surface 320 of the base 312. Each spring clip 330 further has a screw 346 that enters through the through bore 342 in the tail 338 of an associated spring clip 331 and threads into the associated blind bore 344 in the bow-facing surface 320 of the base 312, and in so doing, maintains each spring clip 331 attached to the base 312.

It will be understood that each of the elements described above, or two or more together, may also find a useful application in other types of constructions differing from the types described above.

While the invention has been illustrated and described as embodied in a bow sight with replaceable sight pin guard, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. An improved bow sight of the type having a base for mounting to a bow, at least one sight pin extending from the base, and a sight pin guard attached to the base and overlying the at least one sight pin, said improvement comprising:

a) the sight pin guard being replaceably attached to the base in such a manner so as to allow the sight pin guard to be removed from the base without a need for tools and without the at least one sight pin being removed from the base so as to allow the at least one sight pin to remain in place on the base while the sight pin guard is removed from the base so as to prevent the sight pin guard from obstructing view of a target during aiming with the at least one sight pin and so as to allow the sight pin guard to be replaced onto the base without a need for tools so as to have the sight Din guard protect the at least one sight pin from damage when desired; and b) means for replaceably attaching the sight pin guard to the base without a need for tools.

2. The improved bow sight as defined in claim 1, wherein the sight pin guard has a pair of legs; and wherein said improvement comprises:

a) said means for replaceably attaching including:

i) the base having a pair of blind slots; and ii) the pair of legs of the sight pin guard having a pair of blind slots; and b) said pair of blind slots in said pair of legs of the sight pin guard selectively snapingly engaging with said pair of blind slots in said base.

3. The improved bow sight as defined in claim 2, wherein the base has a pair of ends; and wherein said improvement comprises said pair of blind slots in the base being disposed in the pair of ends thereof, respectively.

4. The improved bow sight as defined in claim 3, wherein the base has:

a) a bow-facing surface; and b) an ambient-facing surface; and wherein said improvement comprises:

a) said pair of blind slots in the pair of ends of the base extending vertically therein; and b) said pair of blind slots in the pair of ends of the base extending from the bow-facing surface thereof to the ambient-facing surface thereof.

5. The improved bow sight as defined in claim 2, wherein the pair of legs of the sight pin guard have terminal ends; and wherein said improvement comprises said pair of blind slots in the pair of legs of the sight pin guard, respectively, being disposed in proximity to the terminal ends thereof.

6. The improved bow sight as defined in claim 2, wherein the pair of legs of the sight pin guard have inner-facing surfaces; and wherein said improvement comprises said pair of blind slots in the pair of legs of the sight pin guard, respectively, extending vertically in the inner-facing surfaces thereof.

7. The improved bow sight as defined in claim 2, wherein said improvement comprises:

a) said pair of blind slots in the pair of legs of the sight pin guard having heights;

b) said pair of blind slots in the pair of legs of the sight pin guard having widths; and c) said heights and said widths of said pair of blind slots in the pair of legs of the sight pin guard being a same as that of said pair of blind slots in the base so as to afford snug engagement therebetween.

8. The improved bow sight as defined in claim 2, wherein said improvement comprises said means including the pair of legs of the sight pin guard having a pair of ramp surfaces, respectively.

9. The improved bow sight as defined in claim 8, wherein the pair of legs of the sight pin guard has terminal ends; and wherein said improvement comprises:

a) said pair of ramp surfaces on the pair of legs of the sight pin guard extending from the terminal ends of the pair of legs of the sight pin guard to said pair of blind slots in the pair of legs of the sight pin guard; and b) said pair of ramp surfaces on the pair of legs of the sight pin guard assist in engaging said pair of blind slots in the pair of legs of the sight pin guard with said pair of blind slots in the base by directing the terminal ends of the pair of legs of the sight pin guard down through said pair of blind slots in the base.

10. The improved bow sight as defined in claim 1, wherein the sight pin guard has a pair of legs; and wherein said improvement comprises:

a) said means for replaceably attaching including:

i) the base having a pair of spring clips; and ii) the pair of legs of the sight pin guard having a pair of indents; and b) said pair of indents in the pair of legs of the sight pin guard being selectively snapingly engaged by said pair of spring clips on the base.

11. The improved bow sight as defined in claim 10, wherein the base has a pair of ends; and wherein said improvement comprises said pair of spring clips on said base being disposed on the pair of ends thereof, respectively.

12. The improved bow sight as defined in claim 10, wherein the base has:

a) a bow-facing surface; and b) an ambient-facing surface; and wherein said improvement comprises:

a) said pair of spring clips on said base extending vertically therealong; and b) said pair of spring clips on said base extending from said bow-facing surface thereof to past said ambient-facing surface thereof.

13. The improved bow sight as defined in claim 10, wherein the pair of legs of the sight pin guard have outer-facing surfaces; and wherein said improvement comprises said pair of indents in the pair of legs of the sight pin guard, respectively, extending in said outer-facing surfaces thereof.

14. The improved bow sight as defined in claim 10, wherein the pair of legs of the sight pin guard have terminal ends, respectively; and wherein said improvement comprises said pair of indents in the pair of legs of the sight pin guard, respectively, being disposed in proximity to the terminal ends thereof.

15. The improved bow sight as defined in claim 10, wherein said base has:

a) a pair of ends; and b) a bow-facing surface; and wherein said improvement comprises:

a) each spring clip having a body;

b) each spring clip having a tail;

c) each spring clip having a head;

d) said body of each spring clip facing an associated end of the base;

e) said tail of each spring clip depending from said body thereof;

f) said tail of each spring clip abutting against the bow-facing surface of the base;

g) said head of each spring clip extending upwardly from said body thereof; and h) said head of each spring clip selectively snaplingly engaging in said indent in an associated leg of the sight pin guard.

16. The improved bow sight as defined in claim 15, wherein said improvement comprises:

a) said body of each spring clip being flat;

b) said tail of each spring clip being flat;

c) said head of each spring clip being C-shaped; and d) said head of each spring clip being sized to afford a snug engagement in said indent in the associated leg of the sight pin guard.

17. The improved bow sight as defined in claim 15, wherein said improvement comprises:

a) said tail of each spring clip having a through bore; and b) said through bore in said tail of each spring clip aligning with an associated one of a pair of blind bores in the bow-facing surface of the base.

18. The improved bow sight as defined in claim 17, wherein said improvement comprises:

a) each spring clip having a screw; and b) said screw of each spring clip entering through said through bore in said tail of an associated spring clip and threading into said associated blind bore in the bow-facing surface of the base, and in so doing, maintaining each spring clip attached to the base.

* * * * *